US009624017B2

(12) United States Patent
Kruse et al.

(10) Patent No.: US 9,624,017 B2
(45) Date of Patent: Apr. 18, 2017

(54) STAND-UP BAG FOR POURABLE GOODS AND METHOD FOR MANUFACTURING THE STAND-UP BAG

(75) Inventors: Alfons Kruse, Dinklage (DE); Jochen Brauer, Lohne (DE)

(73) Assignee: Nordenia Deutschland Halle GmbH, Halle/Westf (DE)

( * ) Notice: Subject to any disclaimer, the term of this patent is extended or adjusted under 35 U.S.C. 154(b) by 343 days.

(21) Appl. No.: 13/242,138

(22) Filed: Sep. 23, 2011

(65) Prior Publication Data

US 2012/0076441 A1 Mar. 29, 2012
US 2012/0263399 A9 Oct. 18, 2012

(30) Foreign Application Priority Data

Sep. 27, 2010 (EP) ..... 10180334

(51) Int. Cl.

| | |
|---|---|
| ***B65D 33/06*** | (2006.01) |
| ***B65D 75/56*** | (2006.01) |
| ***B31B 37/00*** | (2006.01) |
| ***B65D 75/00*** | (2006.01) |
| ***B65D 75/58*** | (2006.01) |

(52) U.S. Cl.

CPC ..... *B65D 75/56* (2013.01); *B31B 37/00* (2013.01); *B65D 33/06* (2013.01); *B65D 75/008* (2013.01); *B65D 75/5883* (2013.01); *B31B 2219/145* (2013.01); *B31B 2219/23* (2013.01); *B31B 2219/9054* (2013.01); *B31B 2219/9077* (2013.01); *B31B 2219/9096* (2013.01); *B31B 2221/20* (2013.01); *B31B 2221/50* (2013.01); *B31B 2237/20* (2013.01)

(58) Field of Classification Search

CPC ..... B65D 33/06; B65D 33/10; B65D 33/105; B65D 33/14

USPC ..... 383/6, 12, 80, 906, 25, 14, 16, 17, 20, 383/21, 22, 24, 104, 7, 10, 28

See application file for complete search history.

(56) References Cited

U.S. PATENT DOCUMENTS

| | | | | |
|---|---|---|---|---|
| 3,208,492 A * | 9/1965 | Braithwaite | ..... | B65D 33/065 383/20 |
| 3,504,841 A * | 4/1970 | Bramson | ..... | 383/6 |
| 3,732,661 A * | 5/1973 | Goldberger et al. | ..... | 53/134.1 |
| 4,148,431 A * | 4/1979 | Lepisto | ..... | 383/14 |

(Continued)

FOREIGN PATENT DOCUMENTS

WO WO 9316928 A1 * 9/1993 ..... B31B 37/00

OTHER PUBLICATIONS

Doyen (WO 9316928 A1) translation.*

*Primary Examiner* — Jes F Pascua
*Assistant Examiner* — Nina Attel
(74) *Attorney, Agent, or Firm* — Armstrong Teasdale LLP

(57) ABSTRACT

A stand-up bag for pourable goods includes a front wall, a back wall coupled to the front wall at a first side edge and an opposite second side edge, and a base fold, wherein the front wall, the back wall, and the base fold are manufactured from a film, and wherein the base fold provides a standing base and is coupled to lower edges of the front wall and the back wall. The bag further includes a bag top situated opposite from the base fold, a closure device, wherein the closure device is attached proximate the bag top, and a carrying handle on the first side edge between the base fold and the bag top, the carrying handle positioned a distance from the base fold and the bag top.

22 Claims, 11 Drawing Sheets

(56) References Cited

U.S. PATENT DOCUMENTS

| | | | | |
|---|---|---|---|---|
| 4,539,705 | A * | 9/1985 | Baines | 383/21 |
| 5,279,440 | A * | 1/1994 | Fougeres et al. | 220/288 |
| 6,092,933 | A * | 7/2000 | Treu | 383/104 |
| 6,164,826 | A * | 12/2000 | Petkovsek | 383/210.1 |
| 6,796,712 | B1 * | 9/2004 | Achhammer | 383/80 |
| 7,055,720 | B1 * | 6/2006 | Pritchard | 222/107 |
| 7,396,163 | B2 * | 7/2008 | McGregor | 383/204 |
| 7,670,050 | B2 * | 3/2010 | Haimerl et al. | 383/28 |
| 7,976,220 | B2 * | 7/2011 | Brauer et al. | 383/204 |
| 8,007,174 | B2 * | 8/2011 | Yamaguchi et al. | 383/9 |
| 8,181,823 | B2 * | 5/2012 | Fukuizumi et al. | 222/107 |
| 8,414,188 | B2 * | 4/2013 | Koesters | 383/26 |
| 2002/0076471 | A1 * | 6/2002 | Olsson | 426/86 |
| 2002/0094923 | A1 * | 7/2002 | Edwards et al. | 493/221 |
| 2003/0029884 | A1 * | 2/2003 | Rau | 222/92 |
| 2004/0131285 | A1 * | 7/2004 | Shepard et al. | 383/120 |
| 2006/0210199 | A1 * | 9/2006 | Ali | 383/10 |
| 2007/0133909 | A1 * | 6/2007 | Arvizu | 383/104 |
| 2007/0211967 | A1 * | 9/2007 | Murray | 383/38 |
| 2008/0080794 | A1 * | 4/2008 | Kruse et al. | 383/14 |
| 2008/0301910 | A1 * | 12/2008 | Lawrence | 16/407 |
| 2009/0022433 | A1 * | 1/2009 | Goglio et al. | 383/104 |
| 2009/0277916 | A1 * | 11/2009 | Steele | 220/754 |
| 2011/0286688 | A1 * | 11/2011 | Gum et al. | 383/64 |

* cited by examiner 17
15
1
8
17
X
15
1
5a
5b
15
8
1
14

STAND-UP BAG FOR POURABLE GOODS AND METHOD FOR MANUFACTURING THE STAND-UP BAG

CROSS REFERENCE TO RELATED APPLICATIONS

This application claims the benefit of European Patent Application No. EP 10 180 334.4 filed Sep. 27, 2010, which is hereby incorporated by reference in its entirety.

BACKGROUND OF THE INVENTION

The field of the invention relates generally to a stand-up bag for pourable goods and, more particularly, to a stand-up bag made from a film having a front wall, a back wall, a base fold, a bag top, and a closure device attached proximate the bag top. The field of the invention further relates to a method for manufacturing a stand-up bag.

At least some known stand-up bags are described in European Patent Application Nos. EP 0 772 554 B1, EP 1 233 915 B1, and EP 1 737 752 B1. The stand-up bags described in these references have a pour spout with a screw-on closure which is centrally attached at the upper edge of the stand-up bag, between the front wall and a flap of a top fold provided at the bag top. When filled, the stand-up bags in these references have a bulging, approximately hexagonal shape, and may be gripped by the hand of a user and then handled as one would handle a beverage can or beverage bottle. Accordingly, to allow the stand-up bag to be gripped and thus easily handled, at least some known stand-up bags cannot exceed a certain size.

German Patent Application No. DE 39 25 981 A1 describes a known stand-up bag, which in its top region has a beak-shaped projection as a spout which may be torn open, and a handle. The handle is situated facing a front wall of the bag, while the spout adjoins an upper region of the back wall. After the spout is opened, the bag may be held by the handle and emptied by lifting the underside of the bag. The bag must be handled with both hands, since the spout, as a result of its central location above the back wall, has only limited stability. Accordingly, is difficult to control pouring of the packaged product, and in particular, precisely pouring the product into a filling opening or the like.

In light of this background, the object of the invention is to provide a stand-up bag for pourable goods that has a high capacity and which may be easily and precisely handled. A further aim is to provide a method for manufacturing such a stand-up bag.

BRIEF DESCRIPTION OF THE INVENTION

The subject matter of the invention relates generally to a stand-up bag for pourable goods that includes a front wall, a back wall, and a base fold manufactured from a film. The bag also includes a bag top situated opposite from the base fold, and a closure device. The front wall and the back wall are joined together at a first side edge and at an oppositely situated second side edge. The base fold, which is provided as a standing base, is joined to lower edges of the front wall and the back wall, and the closure device is attached in the region of the bag top.

The subject matter of the invention further relates to a method for manufacturing a stand-up bag. The front and back walls, as well as the base fold and an optional top fold are manufactured from a film. The front and back walls, base fold, and top fold also have heat-sealable interior surfaces such that the stand-up bag may be formed by heat sealing. Multilayer films which are formed by coextrusion and/or lamination may be used. Before laminating, printing may be applied, such that the printing is located on the inside and protected during the lamination of the multilayer film. Within the scope of the invention, the front wall, the back wall, the base fold, and the top fold may be formed either from sections of the same film, or at least partially from different films.

A stand-up bag including the described features is suitable as packaging for liquid, pasty, powdered, or granular products. The possible fields of application include packaging of beverages, liquid concentrates, liquid cleaners, detergents, viscous personal care products, liquid or pelletized animal feeds, powdered or granular construction products, cereals, rice, sugar, flour, or the like.

The stand-up bag may include a closure device that includes, for example, a pouring element in the form of a pour spout and a cap which allows reclosure. Such pour spouts are usually made of a plastic, and are comparatively rigid. The pour spout may be joined at the top fold and at the front wall and/or back wall in a particularly simple manner by heat sealing which achieves reliable seal-tightness by melting polymers.

The exemplary embodiment of the stand-up bag includes a carrying handle situated at the first side edge between the base fold and the bag top, and at a distance from the base fold and the bag top. As a result of providing the carrying handle in a region between the bag top and the base fold, the stand-up bag is tilted when it is raised by the carrying handle, and the bag top including the closure device situated thereon is correspondingly lowered, thus greatly simplifying pouring. After the closure device is opened, if it is not possible to control the pouring or emptying of the bag using one hand, the bag top must be raised or lowered using the other hand of the user. Due to the location of the carrying handle, a substantially low force can be used for controlling the pouring or emptying. Since the carrying handle is situated in the region of the first side edge, the load on the bag body may be optimally distributed without excessive deformation of the stand-up bag. Thus, in the exemplary embodiment, a longitudinal sealing seam which acts as reinforcement for the stand-up bag is provided at least above and below the carrying handle. Providing a carrying handle at a side edge at which the front wall directly adjoins the back wall has not been considered heretofore for a stand-up bag.

The bag top is formed by a top fold that is joined to upper edges of the front wall and the back wall. The closure device is attached to the top fold and at least one of the front wall and the back wall. For a design having a base fold and a top fold, an essentially prismatic, tube-like shape may be achieved which provides an optimum filling volume in relation to the standing surface area of the bag and the bag height.

The carrying handle may be situated at the first side edge, exactly in the middle between the bag top and the base fold. However, depending on the bag geometry and the provided filling, the carrying handle may also be offset slightly upwardly in the direction of the bag top or slightly downwardly in the direction of the base fold. The neutral position of the stand-up bag when lifted by the carrying handle is determined by the position of the carrying handle at the first side edge. A width of the carrying handle causes the carrying handle to extend laterally from the first side edge, and the carrying handle may extend into sections of the front wall and the back wall.

In at least one embodiment, to further improve the handling of the stand-up bag, the closure device is not centrally situated at the bag top, but instead is offset in the direction of the second side edge. The closure device and the carrying handle are then situated obliquely opposite from one another, resulting in handling similar to that of a jug. The closure device may be situated directly at the second side edge, or slightly offset. In another embodiment, an angled corner region extends between the upper end of the second side edge and the bag top, and the closure device may then be situated in this corner region. When the closure device is offset in the direction of the second side edge, at or within a small distance from the second side edge, the region beneath the closure device is significantly stiffened and reinforced by the second side edge. Although the front wall, the back wall, the base fold, and the top fold, which is preferably provided at the bag top, are made of film, increased stability in emptying or pouring may thus be achieved, while also reducing the risk of uncontrolled deformation of the bag due to the flexibility of the film. In particular, greater stability than of known stand-up bags may be achieved.

Within the scope of the embodiments described herein, there are various options for the design of the carrying handle at the first side edge. For example, it is conceivable to provide the first side edge with a wide heat seal, which at that location joins the front wall to the back wall. The wide heat seal may include at least one indentation or at least one punching engageable by the user.

However, according to one embodiment, the carrying handle includes a separate film strip as a carrying strap or part of a carrying strap. Advantageously, no heat sealing seam is then present along the second side edge in the region of the carrying handle, but sealing seams are advantageously formed above and below the carrying handle, at a distance from the carrying handle.

When the front wall and the back wall have heat-sealable outer surfaces, the separate film strip may be easily sealed as a carrying strap at the outer side of the bag. However, according to one embodiment, when only the interior surfaces of the front wall and the back wall are heat-sealable, the separate film strip must be directly or indirectly attached at the inner surface of the front wall and the back wall.

Further design options result when a film strip is used as a carrying strap. The selection depends on the stress, and is a function of the size of the stand-up bag and the filling weight for which it is designed. In one embodiment the film strip is attached at the inner surface of the bag, and is accessible through a grip opening in the region of the first side edge. The attachment of the film strip is established by heat sealing. The grip opening is closed in a liquid-tight manner by a film sheet, which at the back side of the film strip is joined to the inner surface of the bag by a sealing seam which surrounds the grip opening. The grip opening is preferably closed by a detachable film section of the front wall and back wall in the region of the first side edge, so that the film carrying handle is initially situated completely within the contour of the stand-up bag. Bag blanks, which preferably leave a bag manufacturing facility initially flat and unfilled, have smooth surfaces and therefore may be easily stacked and transported. When the carrying handle is concealed beneath a smooth outer surface, the stand-up bags may be easily stacked.

The following design is advantageous when the carrying handle must be designed for high stresses. In this case the carrying handle has a loop, composed of the film strip, which surrounds a carrier sheet. The carrier sheet, which projects at both sides of the loop, is preferably attached by heat sealing at a film sheet on the back side and/or at the inner surface of the bag. The described design of the carrying handle has the advantage that the force applied when the stand-up bag is carried is initially distributed on the carrier sheet, and thus, over a large surface area. The uniform distribution of force allows large loads to be transmitted.

For fairly small stand-up bags which are designed for a smaller filling weight, the carrying handle may also be designed as a simple film strip. For attaching such a film strip, it is appropriate to thermally join the ends of the film strip to a film sheet through openings in the bag covering. The film sheet is attached to the inner surface of the bag via sealing seams, and the openings are closed in a liquid-tight manner. According to another embodiment, a reinforcing sheet is situated at the inner surface of the bag and joined to the inner surface by heat sealing. This forms a carrying strap composed of a section of the bag film, adjoined by two slits at the edge, and the reinforcing sheet. In addition, a closure sheet is provided which covers an opening, formed by the carrying strap, in the interior of the bag. To achieve increased load capacity, the slits which define the carrying strap may each be situated between two sealing seams, and the reinforcing sheet is sealed to the inner surface of the bag.

The front wall and the back wall are joined at the second side edge by a longitudinal sealing seam. In particular, the front wall and the back wall may be jointly formed from a film cutting by folding the film cutting on itself along the first side edge. As used herein, a film cutting is a section or blank of film material. As described above, when a separate film strip is used, a longitudinal sealing seam is situated at the first side edge and is interrupted along the carrying handle. A sealing seam is not necessary at that location, since the front wall and the back wall are formed from a shared film cutting which is folded on itself along the first side edge. Thus, the front wall and the back wall directly merge into one another at the first side edge. However, to allow integration of the base fold and a top fold, the front wall and the back wall must be separated above and below the carrying handle and subsequently rejoined at that location by heat sealing. When no heat sealing is provided in the region of the carrying handle, the first side edge does not include a sharp crease in that region. Accordingly, in the filled state the stand-up bag has a bulging shape at that location. It is advantageous that sealing seams situated above and below the carrying handle terminate at a certain distance from the carrying handle, so that the stand-up bag formed from the film is able to deform to a certain extent.

The top fold and the base fold have a central folded edge extending in the transverse direction of the stand-up bag, and two flaps projecting therefrom. The base fold and the top fold generally have approximately equal dimensions. To improve the pouring and emptying characteristics, however, it may be advantageous for the base fold to be wider than the top fold. This means that in the flat state of the stand-up bag, the base fold forms a deeper fold than the top fold. In the filled state, the stand-up bag correspondingly has a shape which tapers upwardly to a certain extent.

According to the exemplary embodiment, in which the closure device is offset in the direction of the second side edge, the closure device, depending on its design, may be inserted at both flaps and at the front wall and the back wall. Alternatively, the closure device may be inserted between one of the flaps and one of the front wall and the back wall. The latter embodiment is particularly advantageous when the closure device is designed as a pouring element, for example in the form of a pour spout. Such a pouring element is usually made of rigid plastic, and preferably includes a cap which allows reclosure. The cap may be affixed by screwing or snapping on, for example.

According to one embodiment, the described pouring element may be provided in combination with an angled corner region which extends from the second side edge, the pouring element situated in the angled corner region. The pouring element and pouring direction are then situated obliquely upward. In addition, as a result of the described configuration, it is possible that for a filled stand-up bag the pouring element does not extend or does not extend significantly, beyond the base area of the stand-up bag. The pouring element is thus advantageously protected from damage. When the pouring element does not extend or does not extend significantly significantly, beyond the base area, this also allows the stand-up bag to have a substantially small shape, so that filled stand-up bags may be densely packed. Lastly, by providing an angled corner region in which the pouring element is situated, a funnel effect is also achieved in the direction of the pouring element.

In one embodiment, the closure device has reclosure strips which are connectable to one another. These strips may be joined and separated either as a zipper by manually pushing or pulling, or as sliders having an additional sliding element. For a slider closure, the sliding element must be accessible during use, for which purpose it may have to be exposed before being used for the first time. However, reclosure strips which are connectable to one another as a zipper and may be inserted into the bag in an offset manner. Such reclosure strips may be situated between one of the flaps and one of the front wall and the back wall on the other hand. However, in some embodiments, one reclosure strip is attached at both flaps of the top fold, and the other reclosure strip is attached at the front wall and the back wall. Within the scope of such embodiments, when the reclosure device is open, the top fold is upwardly foldable, thus forming a particularly large, approximately diamond-shaped removal opening. To reclose the closure device, the top fold is then folded back between the front wall and the back wall, the closure strips being joined by pressing together. The reclosure strips may be situated parallel or at least approximately parallel to the second side edge.

Depending on the type of closure device and the attachment of the closure device, it is desirable to prevent filling material from collecting in corners or edges and reaching the closure device. Accordingly, the stand-up bag may be provided with additional heat sealing seams for controlling the filling material. When reclosure strips, for example, are provided as a closure device, beneath the reclosure strips, i.e., in the direction of the standing base, a joining line may be provided. The joining line starts at the second side edge and extends obliquely upward. The joining line joins the front wall to the back wall. The joining line advantageously terminates approximately at the lower end of the closure strips.

According to another embodiment, it may be provided that the closure device is concealed by a detachable bag section prior to opening the bag for the first time. Such a design is advantageous in particular for a closure device which has reclosure strips that are connectable to one another. The detachable bag section usually includes portions of the front wall and the back wall, and optionally also a portion of the top fold. However, it is also conceivable for the top fold to have a design which is trimmed beforehand, in which case a sufficient seal must be ensured to connect the top fold to the front wall and to the back wall. To form the detachable bag section, a tear line may be provided between the second side edge and the closure device, for example.

A number of polymers and material combinations are suitable as plastic film for producing the stand-up bag. In particular, the stand-up bag may be produced from transparent polymers, or may be provided with windows to allow identification of the filling level. Examples of advantageous material combinations are polyethylene-terephthalate/polyethylene (PET/PE), oriented-polypropylene/polyethylene (OPP/PE), polyethylene-terephthalate/oriented-polyamide/polypropylene (PET/OPA/PP), oriented-polyproplylene/polypropylene (OPP/PP), and polyethylene/polyethylene (PE/PE). In addition, transparent barrier layers may be provided by SiOx-coated films or coextruded barrier polymer layers such as ethylene vinyl alcohol (EVOH). Composite materials containing one or more layers of biodegradable and renewable raw materials may also be used as plastic films. Cellulose/starch polyester and oriented-polylactide/polyactide (OPLA/PLA) polyester compounds are named as examples. However, composite materials containing a metallic interlayer or an interlayer made of a metal-coated polymer are particularly suitable for the stand-up bag according to the invention. Advantageous material combinations are polyethylene-terephthalate/aluminum/polyethylene (PET/Alu/PE) polyethylene-terephthalate/aluminum/polypropylene (PET/Alu/PP), and metal coated OPP/PP.

The thickness of the plastic film is largely dependent on the bag size and the filling weight for which the stand-up bag is designed. A stand-up bag for liquids, having a filling volume of approximately 2.5 liters, may be made, for example, of a plastic film having a three-layer structure composed of an outer PET layer 12 μm thick, a PET interlayer 12 μm thick, and a polyethylene layer 100 μm thick at the inner side of the bag. Lastly, to increase the drop strength, fabric may also be introduced into the film composite. Such a plastic film has, for example, a layer composite composed of PE/fabric/PE.

The subject matter of the invention further concerns a method for manufacturing a stand-up bag. The method includes positioning a carrying handle arrangement having at least one film strip on a film section, folding the film section on itself to form a front wall and a back wall such that the carrying handle arrangement is on a first side edge of the folded film section, wherein the front wall and the back wall are separated along the first side edge by the carrying handle arrangement, forming a base fold between the front wall) and the back wall in an orientation transverse to the first side edge, and providing a closure device proximate a bag top, wherein the stand-up bag is formed by heat sealing.

After the film section is folded over, the edges of the film section situated opposite from the first side edge form a second side edge, wherein the front wall and the back wall are joined together by a heat sealing seam over a portion of the second side edge, and not over the entire length of the second side edge. An upper section and a lower section of the second side edge are initially removed from a heat sealing unit in order to subsequently introduce and attach the base fold and the top fold at that location. For the same purpose, separation of the back wall and the front wall in sections is also necessary at the first side edge, which is formed by folding.

In order to manufacture stand-up bags, or bag blanks provided for subsequent filling, in large numbers, it is advantageous to initially supply a material web and to apply carrying handle arrangements in the longitudinal direction of this material web. Regions having one carrying handle arrangement each then correspond to the above-described film section. The film sections, which initially abut one another contiguously along the material web, are separated after each carrying handle arrangement is laid down. The film section may also be separated after the folding to form the front and back walls.

When the lateral edges of the film sections, i.e., of the material web, form a second side edge, the carrying handle arrangement is centrally situated in the transverse direction of the material web.

After the film sections are separated, they are transported in a transverse direction perpendicular to the side edges. During the transport in the transverse direction, further method steps such as forming the base fold and the top fold may be carried out sequentially and/or concurrently. The base fold and the top fold may be provided as a continuous folded strip, resulting in a cutting which corresponds to the width of the individual folded film sections. The wall located at the top during the manufacturing process, i.e., the front wall or the back wall, is folded at the location where the base fold and the top fold are formed.

The attachment of the top fold and base fold as well as the integration of the closure device are carried out in multiple heat sealing steps. In particular, after forming the top fold, an angled corner region may be formed by the top fold, the front wall, and the back wall The angled corner region extends from the second side edge at an angle, and the closure device is subsequently attached in the angled corner region. Such a design is particularly advantageous for providing a closure device in the form of the previously described pouring element.

According to one alternative embodiment, reclosure strips are situated between the top fold and inner surfaces of the front wall and the back wall. Before forming the top fold, it is possible to fold up the corresponding region such that a first reclosure strip is permanently sealed at the inner surface of the front wall and the inner surface of the back wall. The top fold is then provided and joined to a second reclosure strip that engages the first reclosure strip. Alternatively, it is possible to attach one of the reclosure strips to the top fold before attaching the top fold to the front wall and back wall.

When using a closure device having reclosure strips, a tear line may be formed between the second side edge and the reclosure strips. The tear line may be formed on a bag blank that is open on one side, or on the finished, closed stand-up bag.

During manufacture of the stand-up bag, heat sealing seams may also be produced which are provided essentially for guiding the filling material to the closure device. For example, while the reclosure strips may be situated at a distance from the second side edge, an angled sealing seam which joins the front wall to the back wall may be formed between the second side edge and the reclosure device. For pouring, the filling material is then guided along this angled sealing seam in the direction of the closure device.

BRIEF DESCRIPTION OF THE DRAWINGS

The embodiments described herein are explained below with reference to figures, which represent possible exemplary embodiments solely by way of example.

DETAILED DESCRIPTION OF THE INVENTION

Figure 1:
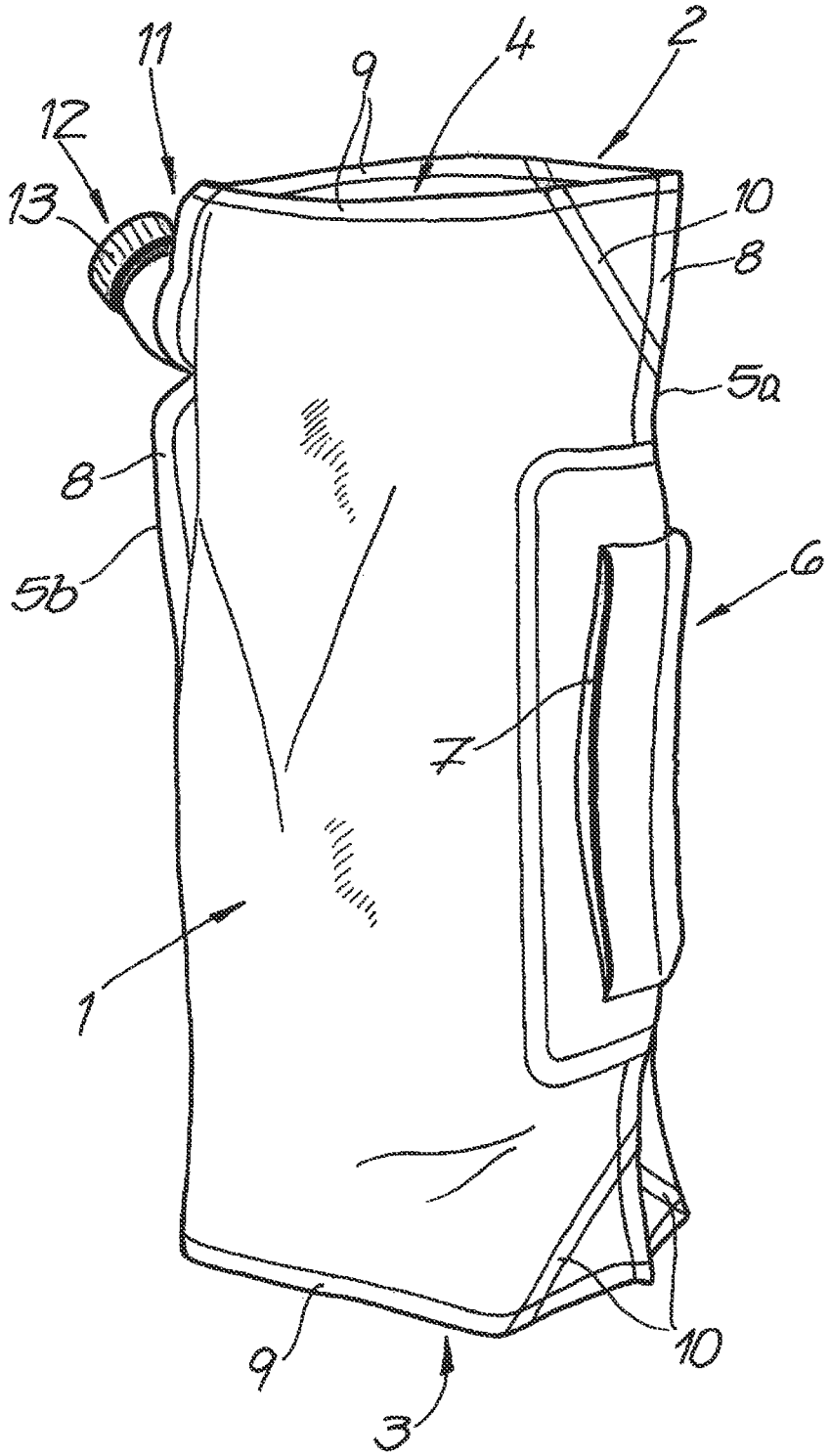
FIG. 1 shows a perspective view of an exemplary stand-up bag in accordance with the present invention.

FIG. 1 shows a stand-up bag for pourable goods that includes a front wall 1, a back wall 2, a base fold 3, and a top fold 4 which are formed from film. The front wall 1 and the back wall 2 are joined together at a first side edge 5*a* and at a second side edge 5*b*. Situated in the vertical direction, halfway up at the first side edge 5*a*, is a carrying handle 6, which in the exemplary embodiment includes a separate film strip 7. The bag is indented in the region of the carrying handle at the front wall 1 and the back wall 2, and the film strip 7 together with the indented region forms a carrying strap which may be accessed from the side. In one embodiment, the carrying strap is initially integrated into the outer surface of the stand-up bag and accessible through a perforation (not illustrated) once the perforation is torn open.

According to the exemplary embodiment, FIG. 1 shows that the front wall 1 and the back wall 2 are jointly formed from a film cutting, or film section, by folding the film cutting on itself along the first side edge 5*a*. Above and below the carrying handle 6, the front wall 1 merges directly into the back wall 2 without an additional connection by a sealing seam.

The film cutting is folded such that the edges of this film cutting may be joined by a longitudinal sealing seam 8 to form the second side edge 5*b*.

The base fold 3, which forms a standing base, is attached at lower edges of the front wall 1 and the back wall 2. The top fold 4 is attached at upper edges of the front wall 1 and the back wall 2. The base fold 3 and top fold 4 are each attached using transverse sealing seams 9. In addition, the lateral ends of the base fold 3 and the top fold 4 are joined to the front wall 1 and the back wall 2 using longitudinal sealing seams 8 and angled corner sealing seams 10. An angled corner region 11 extends from the upper end of the second side edge 5*b*.

In the exemplary embodiment, the stand-up bag also includes a closure device which is attached to the top fold 4 and at least one of the front wall 1 and the back wall 2. This closure device is offset in the exemplary embodiment, starting from the middle of the top fold 4 in the direction of the second side edge 5*b*. FIG. 1 shows one embodiment in which a closure device in the form of a pouring element 12 is formed in the angled corner region 11. The pouring element 12 is thus situated obliquely opposite from the carrying handle 6, which allows for particularly easy handling.

When the stand-up bag is lifted by the carrying handle 6, the vertical orientation of the stand-up bag (as shown in FIG. 1) changes to a horizontal orientation, and the pouring element 12 points obliquely downward. With the pouring element 12 pointing obliquely downward, only a substantially small force may need to be applied for control of the bag. That is, from a neutral position, the bag may be tilted using a substantially small force. Depending on the size of the stand-up bag and the weight of the filling material, the pouring or emptying of the filling material may be controlled by the user raising or lowering the base of the stand-up bag with his other hand, or simply tilting the carrying handle 6 to adjust the desired position and angle of the pouring element 12. The stand-up bag may thus be used as one would use a jug, and even a very large and heavy stand-up bag may be handled with ease.

Overall, particularly high stability of the bag also results from the described arrangement of the carrying handle 6 at the first side edge 5*a*, and of the pouring element 12 proximate the second side edge 5*b*. The longitudinal sealing seams 8 situated above and below the carrying handle 6 thus provide considerable reinforcement and a particularly uniform distribution of force. Particularly high stability is also achieved by the arrangement of the pouring element 12 directly above the second side edge 5*b* in the angled corner region 11. Thus, during pouring or emptying of the filling material, there is no risk of the stand-up bag being uncontrollably deformed, which could greatly interfere with emptying of the stand-up bag. Even for a large stand-up bag, the filling material may be precisely dispensed and, for example, poured into a filling opening or the like.

The pouring element 12 illustrated in FIG. 1 is formed from a rigid plastic, for example by injection molding, and attached in a liquid-tight manner between the front wall 1 and a flap of the top fold 4 by heat sealing. To achieve the most symmetrical configuration possible, the two flaps of the top fold 4 are joined together in the region of the pouring element 12, for example via adhesive connection points. The pouring element 12 illustrated in the exemplary embodiment includes a screw cap 13, thus allowing easy opening and reclosing.

In the filled state the stand-up bag has a bulging shape. The carrying handle 6, situated at the first side edge 5*a*, may be easily gripped from behind since the first side edge 5*a* is not provided with a longitudinal sealing seam and is not strongly creased proximate the carrying handle 6. Because the pouring element 12 is situated in the angled corner region 11, the pouring element 12 also does not extend or at least does not extend significantly, beyond the base area of the stand-up bag, and thus to a certain extent is protected from damage. In addition, multiple stand-up bags may be densely packed without the pouring elements 12 of the individual stand-up bags obstructing the packing of the bags.

In particular, multilayer designs which are heat-sealable on at least one side are suitable as film for the front wall, the back wall, the base fold, and the top fold. To allow the filling level of the stand-up bag to be checked, transparent or translucent designs may be used. Moreover, printing may be provided in a customary manner outside a viewing window, not illustrated in FIG. 1.

For a multilayer laminated bag film, the printing is usually provided before the lamination such that the printing is inside the bag film during the lamination in order to protect the printing from abrasion.

FIGS. 2*a* through 2*h* show the method steps for manufacturing the stand-up bag illustrated in FIG. 1. According to FIG. 2*a*, first a material web 14 of a bag film is supplied in a longitudinal direction. Carrying handle arrangements 15, each having the previously described film strip 7 and at least one cover sheet 16 on the back side, are sealed at equidistant intervals at a heat-sealable side of the material web 14. Each region of the material web 14 that includes a carrying handle arrangement 15 corresponds to a film section from which a stand-up bag is may be subsequently formed.

Figure 2A:
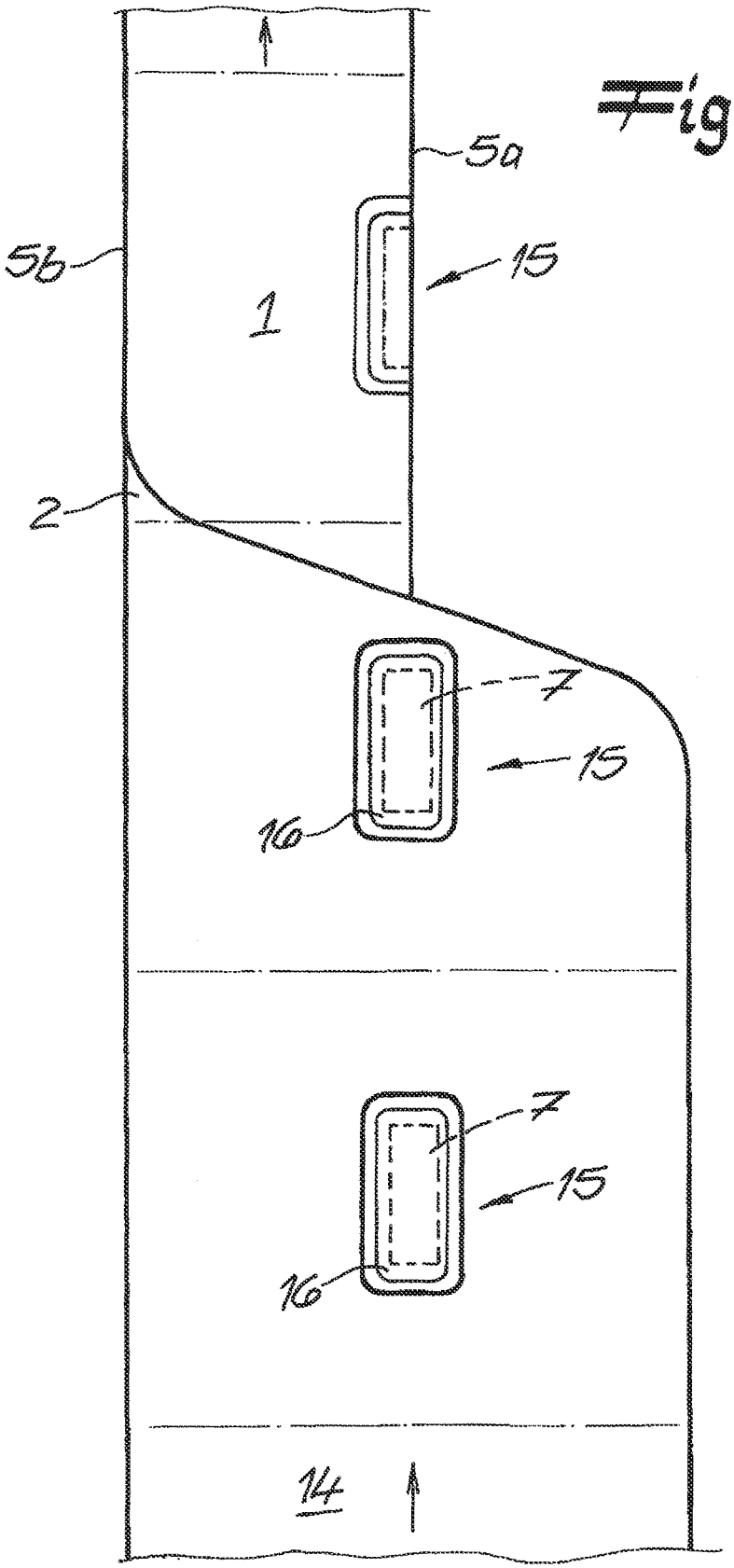
FIGS. 2*a* through 2*h* show individual method steps for manufacturing the stand-up bag according to FIG. 1, FIGS. 3*a* through 3*d* show a modification of the method illustrated in FIGS. 2*a* through 2*h* for manufacturing an alternative embodiment of the stand-up bag.

FIG. 2*a* also shows that the material web 14 is folded into a half loop in such a way that the carrying handle arrangement 15 is situated at a first side edge 5*a*.

Figure 2B:
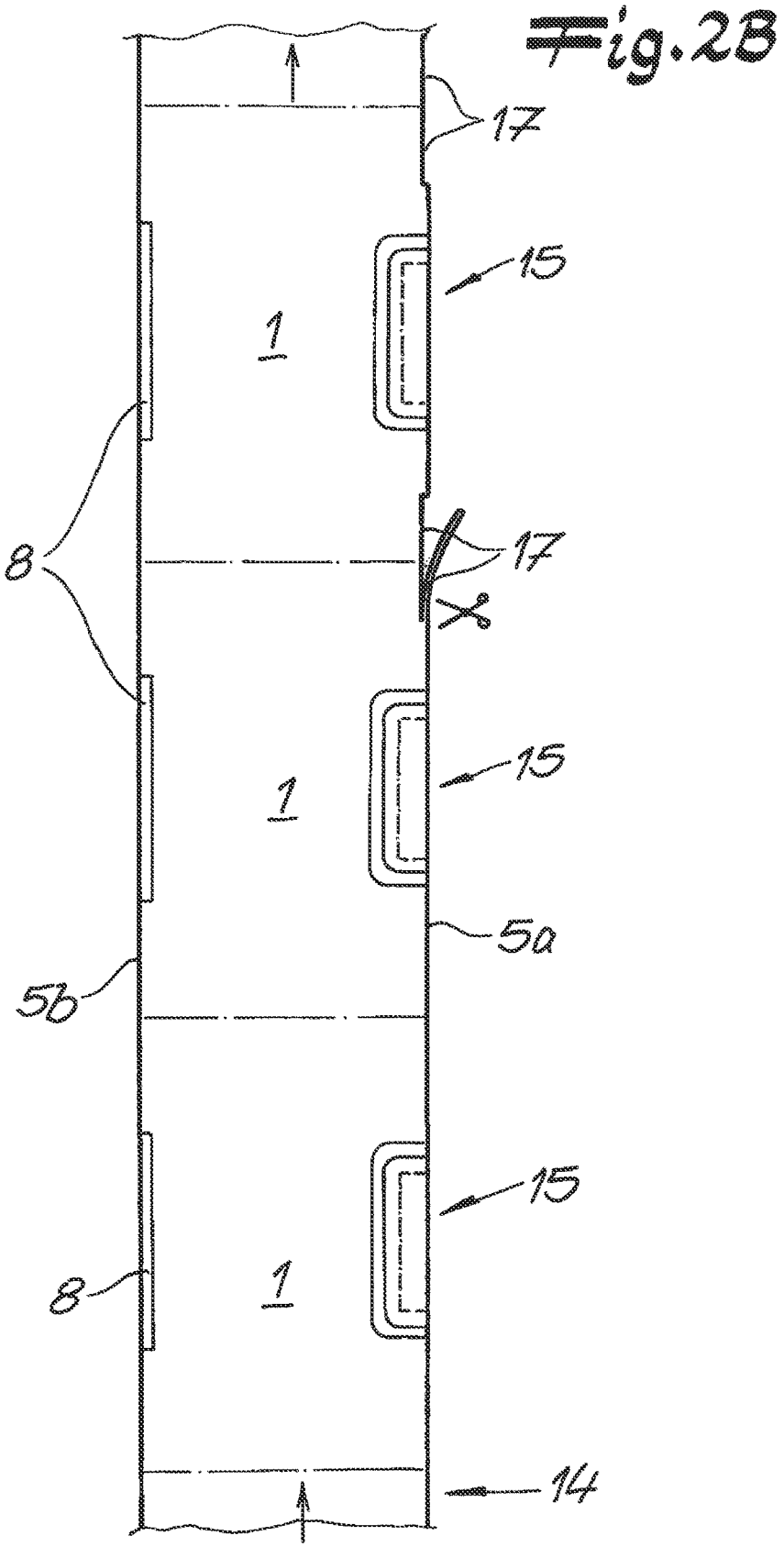
Figure 2C:
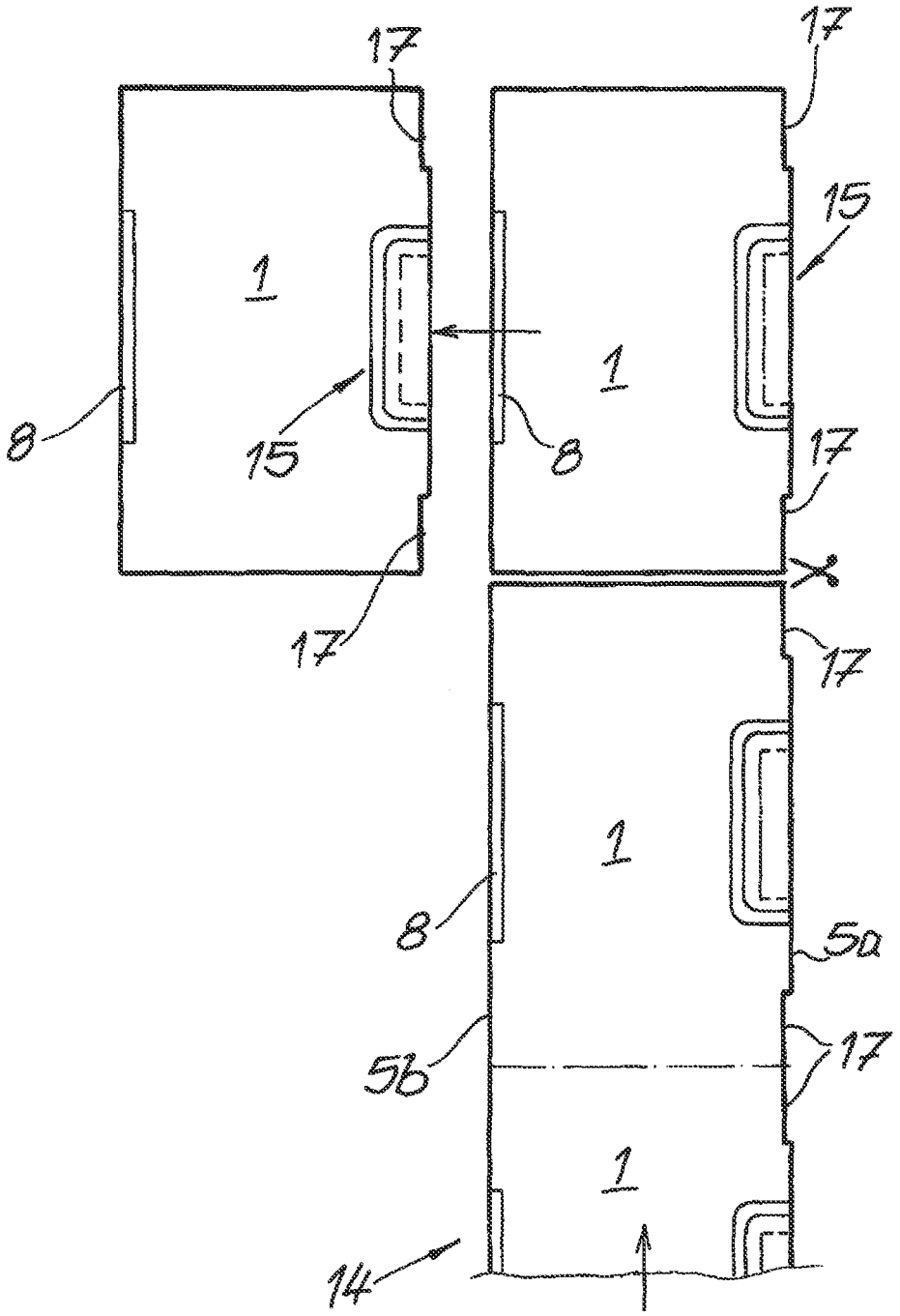

According to FIG. 2*b*, the edges of the material web which are placed one on top of the other are subsequently joined by a longitudinal sealing seam 8 which, viewed in the longitudinal direction of the material web 14, is interrupted at regular intervals. The longitudinal sealing seam 8 which is formed is situated at the level of the carrying handle arrangement 15. At the individual film sections above and below the level of the carrying handle arrangement 15, the edges of the material web 14 are not sealed together at the second side edge 5*b*. In another method step, indentations 17 are formed at the first side edge 5*a*, above and below the carrying handle arrangement. The indentations 17 are preferably produced by cutting off an outer edge of the film in the region of the first side edge 5*a*.

This separation of the front wall 1 and back wall 2 formed by folding the material web 14 is necessary to allow the base fold 3 and the top fold 4 to be subsequently formed.

However, the film sections which initially contiguously abut one another along the material web 14 are separated before forming the base fold 3 and the top fold 4. According to FIG. 2*c*, after the film sections are separated, they are transported in a transverse direction perpendicular to the side edges 5*a*, 5*b*. According to FIG. 2*d*, film sections following in succession are transported one behind the other in the transverse direction, and the upper front wall 1 is folded back above and below the carrying handle arrangement 15 to allow prefolded material strips to be attached as the top fold 4 and the base fold 3. These material strips formed from a film are initially provided as a continuous strip for multiple film sections, and are not separated until later.

Figure 2D:
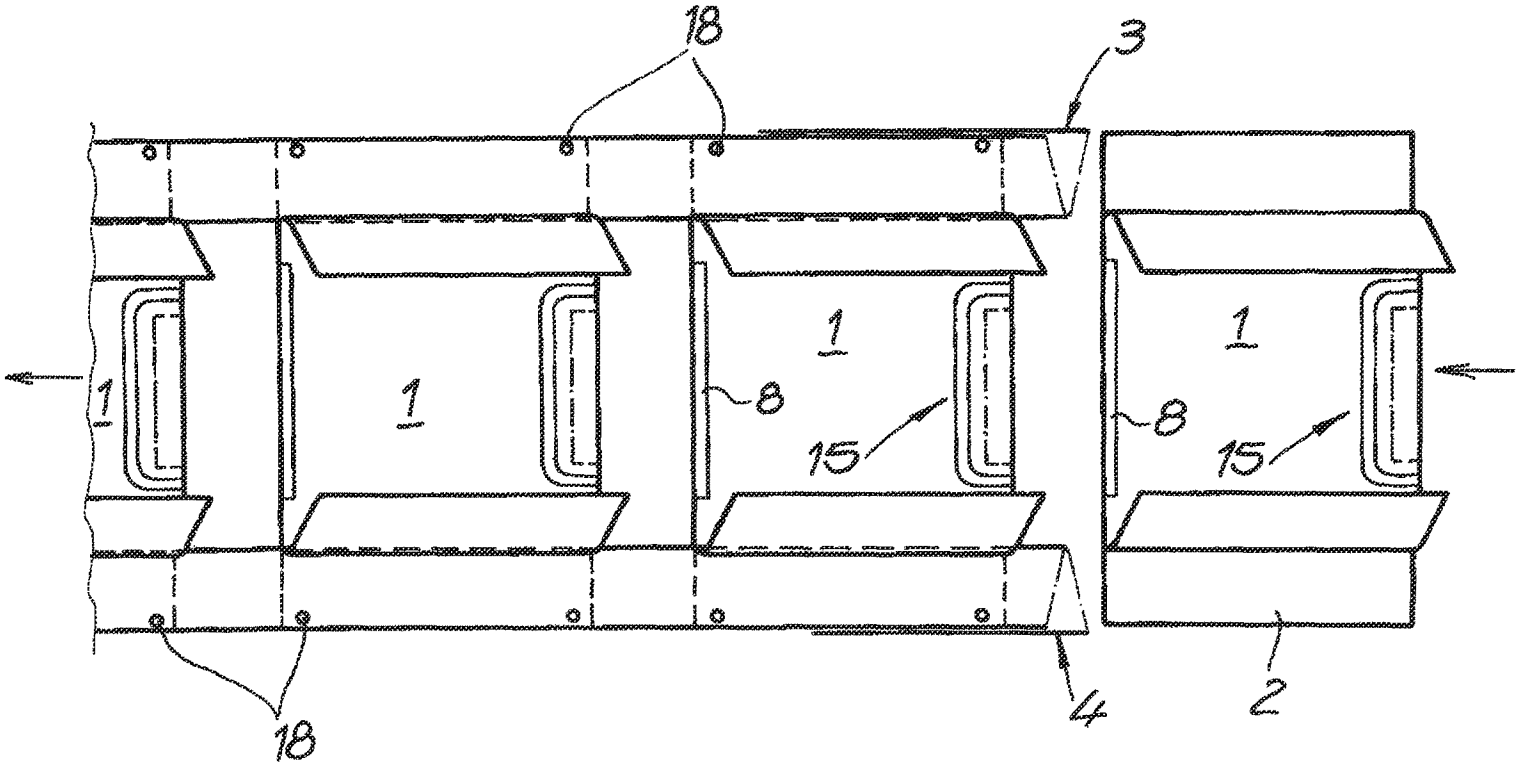

To simplify the forming of the base fold 3 and the top fold 4, these folds are provided with punched holes 18. The folding back of the front walls 1 and the introduction of the base fold 3 and the top fold 4 are illustrated in FIG. 2*d*.

Figure 2E:
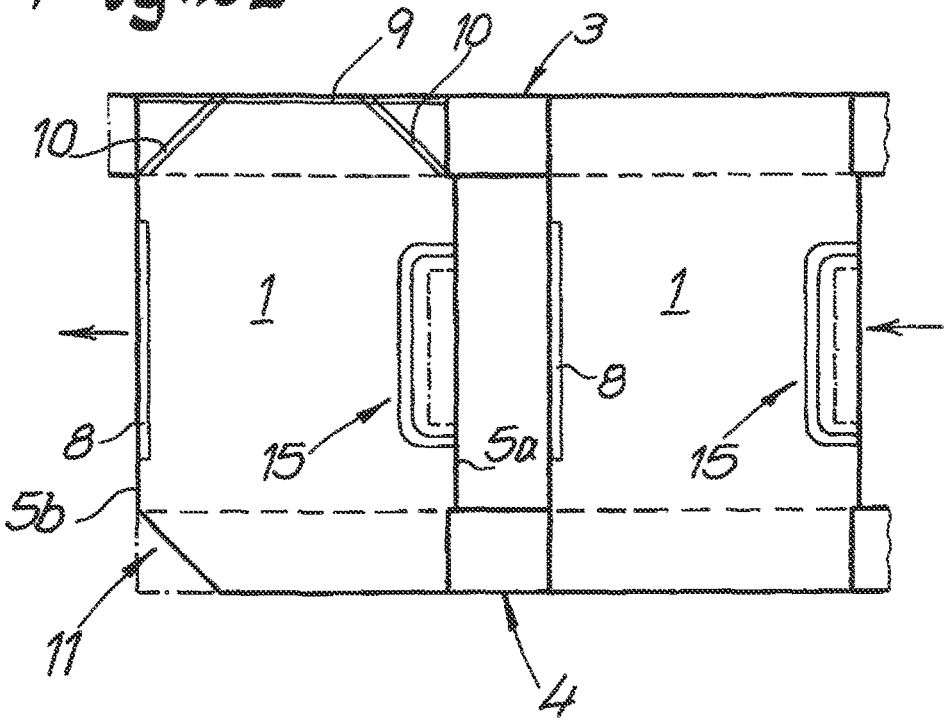

After the top-side and bottom-side end sections of the front wall 1 are folded back (not illustrated), according to FIG. 2*e* the base geometry is formed by providing a transverse sealing seam 9 and two corner sealing seams 10. In addition, at the top fold 4 a corner which adjoins the second side edge 5*b* is obliquely detached, thus forming the angled corner region 11 illustrated in FIG. 1.

Figure 2F:
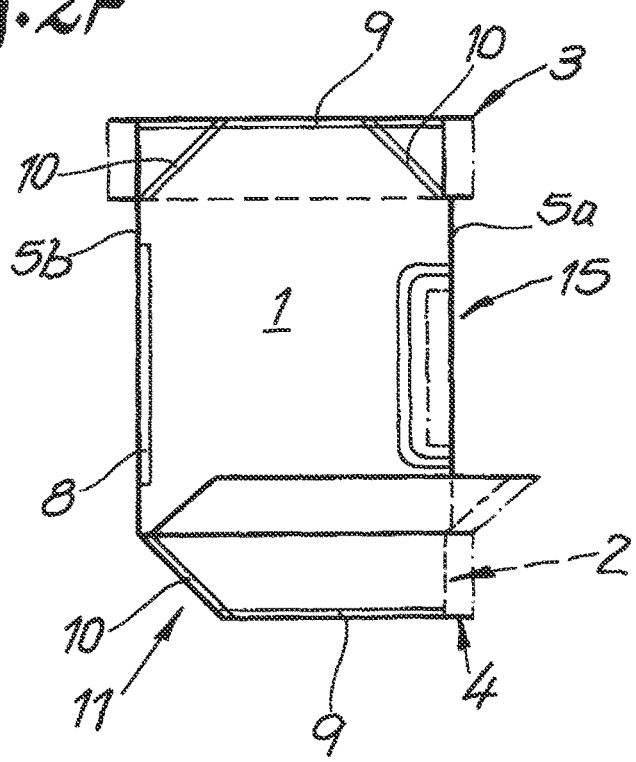

According to FIG. 2*f*, at least the section of the front wall 1 situated on the top fold 4, and preferably a flap of the top fold 4, are then folded back to allow the other flap to be joined to the back wall 2 along a corner sealing seam 10.

Figure 2G:
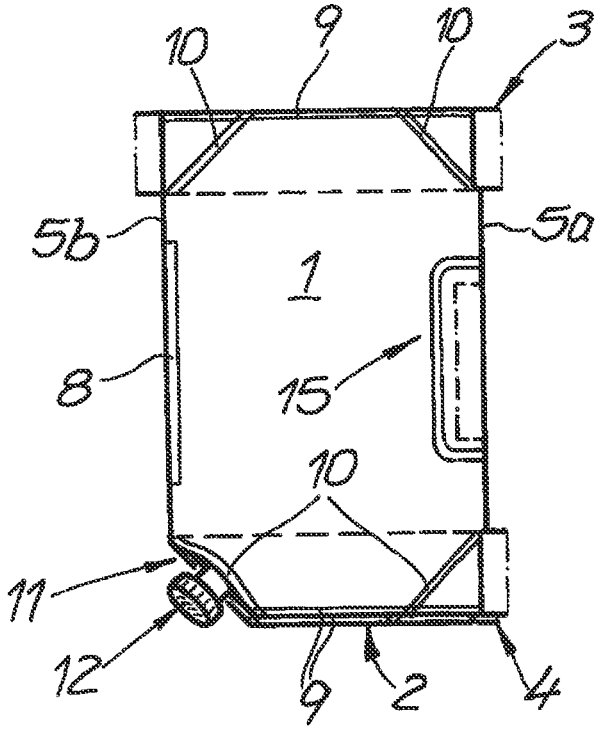

As illustrated in FIG. 2*g*, the closure device in the form of the pouring element 12 is then inserted into the angled corner region 11 between the not yet joined flap of the top fold 4 and the front wall 1, and permanently sealed. A transverse sealing seam 9 as well as corner sealing seams 10 are subsequently formed at the top fold 4.

Figure 2H:
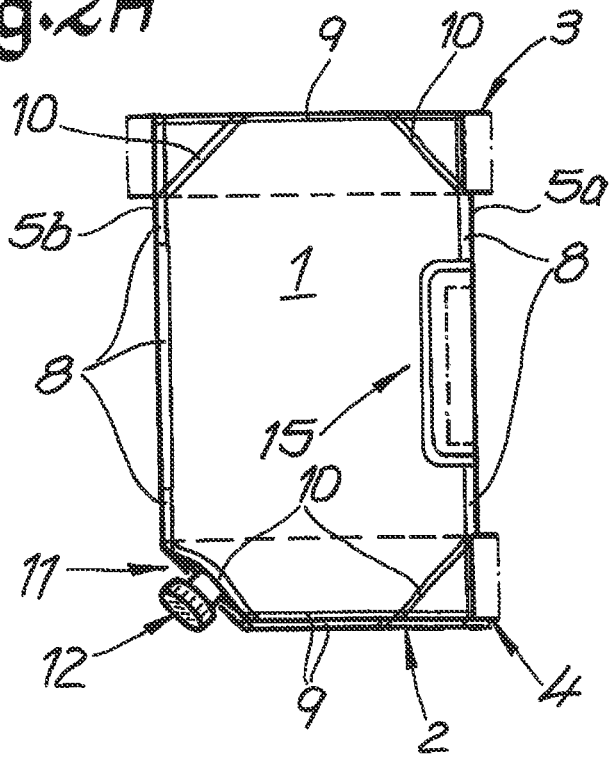

In addition, according to FIG. 2*h*, sections which are not yet closed are closed at the second side edge 5*b* by means of longitudinal sealing seams 8. Additional longitudinal sealing seams 8 are provided opposite from one another at the first side edge 5*a*, above and below the carrying handle 6 which is formed by the carrying handle arrangement 15. The additional longitudinal sealing seams 8 are also provided for reinforcing the first side edge 5*a*.

The sealed bag edges may then be trimmed (not illustrated in the figures), and lastly, the two flaps of the top fold 4 may also be fixed to one another proximate the pouring element 12 by means of adhesive dots, for example.

According to an alternative embodiment of the stand-up bag, the stand-up bag has interlockable reclosure strips 19*a*, 19*b* as a closure device. The carrying handle arrangement 15 is formed, and the base fold 3 is attached, in the same manner as in the manufacturing method illustrated in FIGS. 2*a* through 2*h*. In this regard, reference is made to the above description.

FIGS. 3*a* through 3*d* show a modification of the method illustrated in FIGS. 2*a* through 2*h* for manufacturing embodiments of the stand-up bag that include the reclosure strips 19*a*, 19*b*. According to FIG. 3*a*, in a modification of the method described above, to provide the reclosure strips 19*a*, 19*b*, after the film sections are separated, the section of the front wall 1 at which the top fold 4 is introduced is folded back. In the folded state, one of the closure strips 19*a* is then mounted on the inner surfaces of the front wall 1 and the back wall 2, and is permanently sealed at that location. The other closure strip 19*b* is snapped into the reclosure strip 19*a*.

Figure 3A:
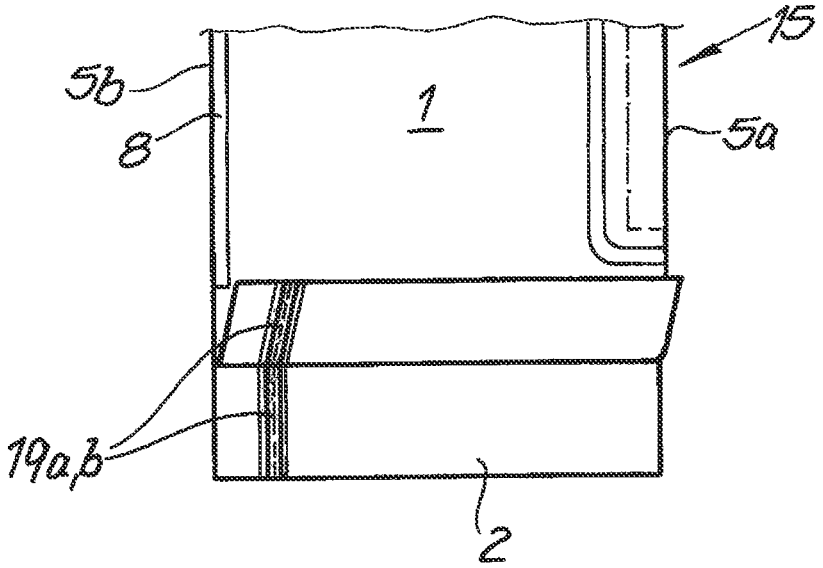
Figure 3B:
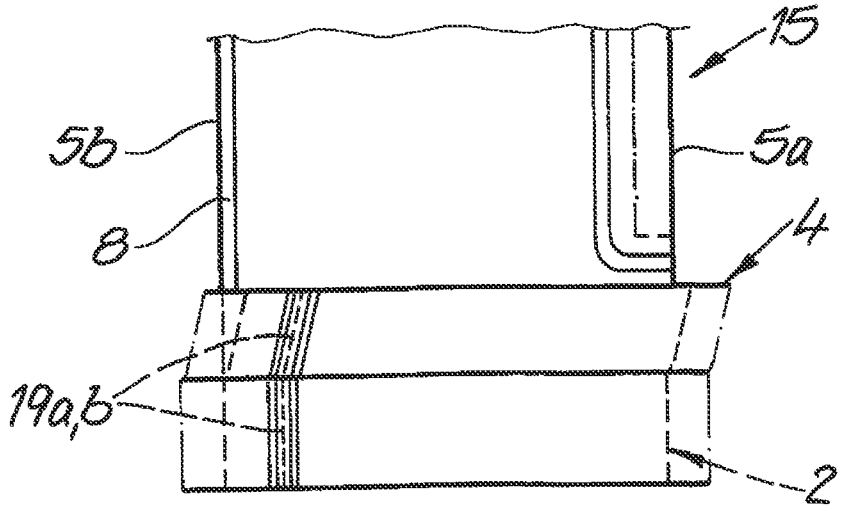

According to FIG. 3*b*, the top fold 4 is sealed to the second reclosure strip 19*b*. The associated part of the front wall 1 is then folded back so that the reclosure strips 19*a*, 19*b* in the region of the top fold 4 are located inside the bag.

Figure 3C:
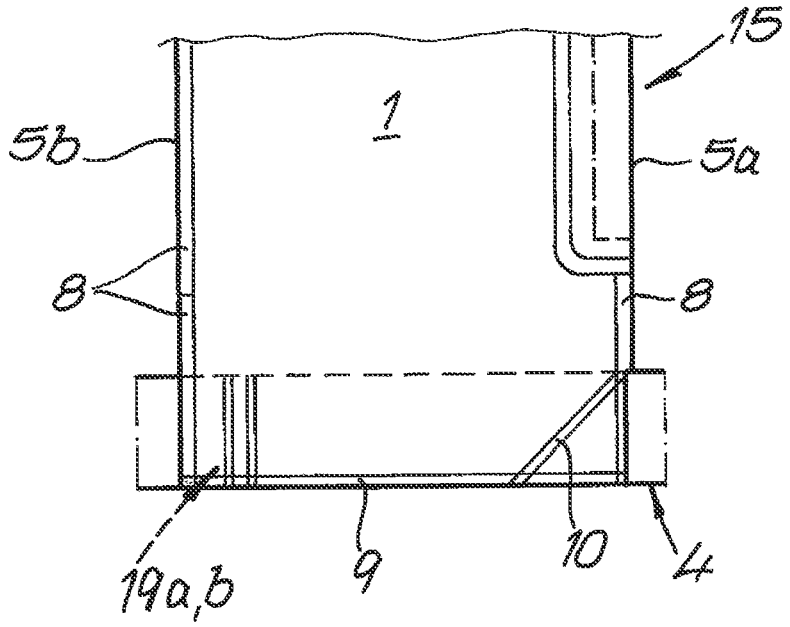
Figure 3D:
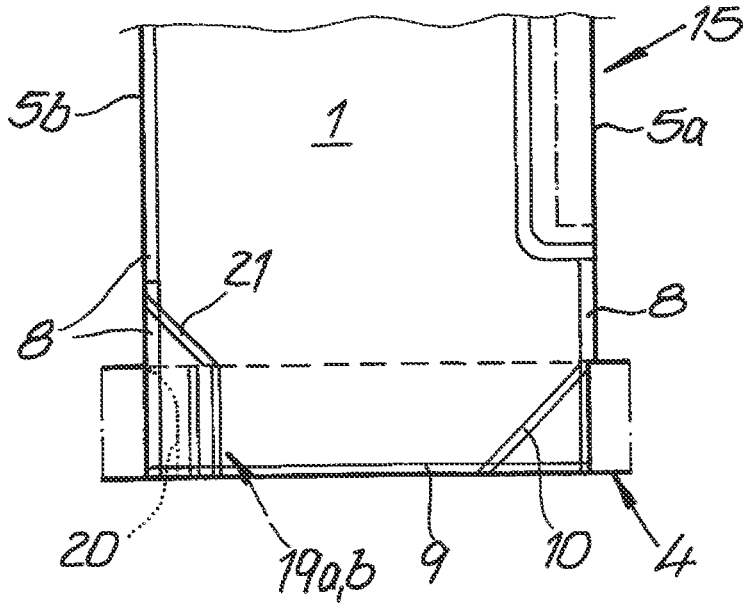

According to FIG. 3*c*, after the front wall 1 is folded back, a transverse sealing seam 9, a longitudinal sealing seam 8 in the region of the second side edge 5*b*, and a corner sealing seam 10 in the region of the first side edge 5*a* are formed.

According to FIG. 3*b*, the reclosure strips 19*a*, 19*b* are slightly offset, starting at the second side edge 5*b*. According to FIG. 3*d*, to allow the stand-up bag to be opened and to gain access to the closure device which is formed by the reclosure strips 19*a*, 19*b*, a tear line 20 is formed between the reclosure strips 19*a*, 19*b* and the second side edge The tear line 20 may be formed, for example, by using a laser or providing a perforation. The previously formed sealing seams may then be trimmed in a customary manner. An angled sealing seam 21 which joins the front wall 1 to the back wall 2 between the second side edge 5*b* and a lower edge of the reclosure strips 19*a*, 19*b* is also formed. This sealing seam 21 is provided in order to guide the filling material in the direction of the reclosure strips 19*a*, 19*b* during pouring, and to avoid undesired accumulation of the filling material.

Figure 4A:
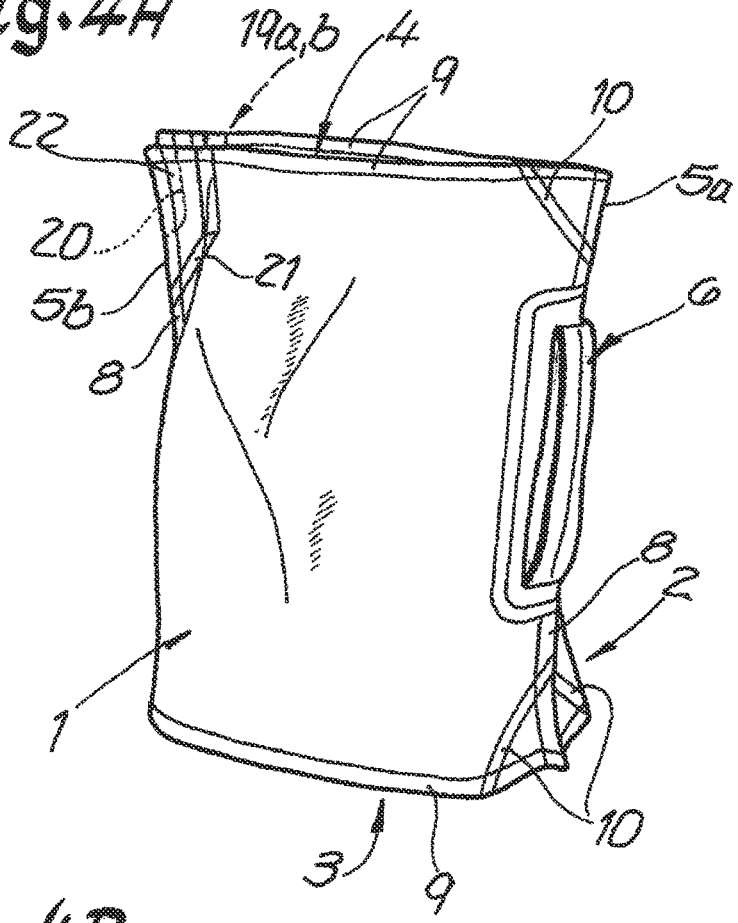
FIG. 4*a* shows a side view of a stand-up bag which is manufactured according to the method illustrated in FIGS. 3*a* through 3*d*.
Figure 4B:
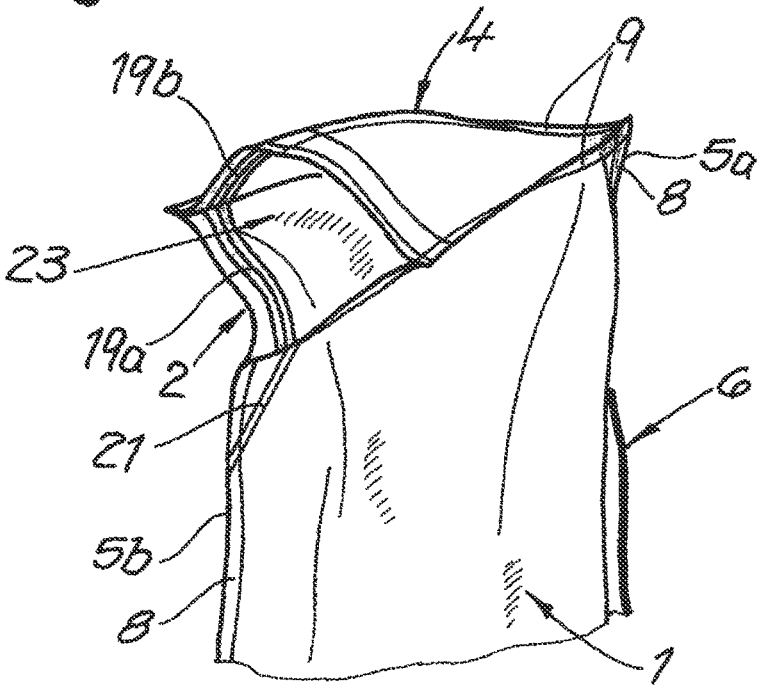
FIG. 4*b* shows the bag according to FIG. 4*a* in the opened state.

FIGS. 4*a* and 4*b* show the stand-up bag produced according to the method illustrated in FIGS. 3*a* through 3*d*. FIG. 4*a* shows the stand-up bag in the closed state, while FIG. 4*b* shows that, after a detachable bag section 22 is torn off along the tear line 20, the top fold 4 may be turned upward, thus forming a particularly large removal opening 23 in which the reclosure strips 19*a*, 19*b* are situated approximately in the shape of a diamond. To allow reclosure of the removal opening 23, the top fold 4 is folded back in between the front wall 1 and the back wall 2, and the reclosure strips 19*a*, 19*b* are locked together by manual pressure.

Figure 5:
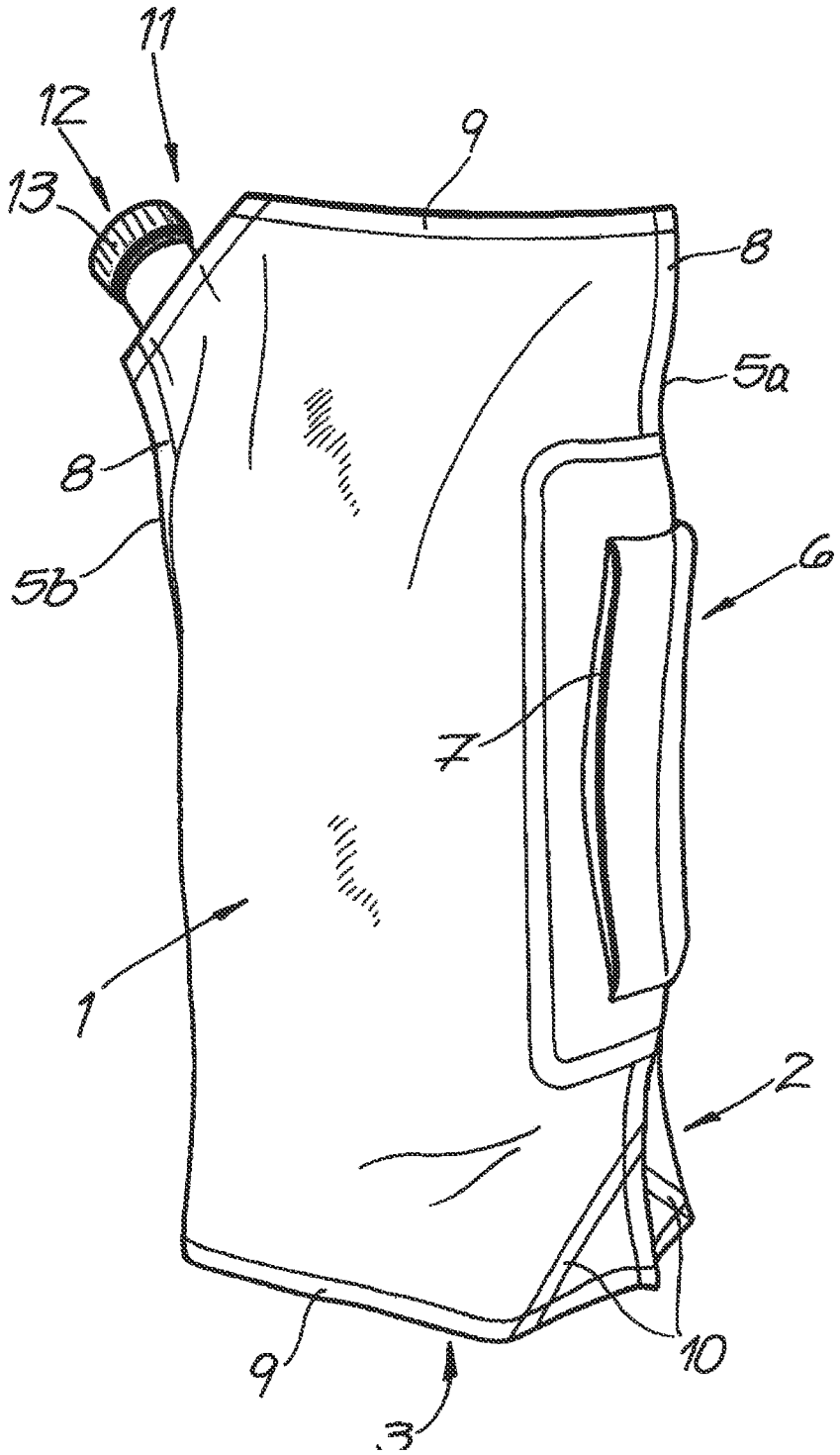
FIG. 5 shows a perspective view of an alternative embodiment of the stand-up bag shown in FIG. 1.

Lastly, FIG. 5 shows an alternative embodiment of a stand-up bag in a view according to FIG. 1. The stand-up bag illustrated in FIG. 5 has only one base fold 3, and the front wall 1 and the back wall 2 are directly joined together at the bag top. The pouring element 12, situated in a corner region 11 of the bag top, is appropriately permanently sealed between the front wall 1 and the back wall 2. The further design of the stand-up bag corresponds to the design according to FIG. 1.

The invention claimed is:

1. A stand-up bag for pourable goods comprising:

a front wall;

a back wall coupled to the front wall at a first side edge and an opposite second side edge, wherein the front wall and the back wall are jointly formed from a first film cutting folded on itself along the first side edge;

a base fold formed from a second film cutting, wherein the base fold provides a standing base and is coupled to lower edges of the front wall and the back wall;

a bag top situated opposite from the base fold;

a closure device, wherein the closure device is attached proximate the bag top;

a carrying handle on the first side edge between the base fold and the bag top, the carrying handle positioned a distance from the base fold and the bag top, the carrying handle coupled to an inner surface of the first film cutting and comprising a film strip;

a first longitudinal sealing seam positioned along the first side edge above the carrying handle; and a second longitudinal sealing seam positioned along the first side edge below the carrying handle, the first and second longitudinal sealing seams being separated from one another by a region of film, wherein the carrying handle overlies the region of film, and wherein the first longitudinal sealing seam and the second longitudinal sealing seam are connected by a frame-shaped sealing seam extending around the carrying handle.

2. A stand-up bag according to claim 1, wherein the closure device is offset towards the second side edge.

3. A stand-up bag according to claim 2, wherein an angled corner region extends between an upper end of the second side edge and the bag top, the closure device positioned in the corner region.

4. A stand-up bag according to claim 1, wherein the film strip forms at least a portion of a carrying strap.

5. A stand-up bag according to claim 1, wherein the region of film separating the first and second longitudinal sealing seams is free of sealing seams.

6. A stand-up bag according to claim 1, wherein the bag top is formed by a top fold that is coupled to upper edges of the front wall and the back wall, and the closure device is attached to at least one of the top fold, the front wall, and the back wall.

7. A stand-up bag according to claim 6, wherein the top fold includes two flaps extending from a central folded edge, the closure device being attached to the flaps, the front wall, and the back wall.

8. A stand-up bag according to claim 6, wherein the top fold includes two flaps extending from a central folded edge, the closure device being attached to one of the flaps and one of the front wall and the back wall.

9. A stand-up bag according to claim 8, wherein the closure device is a pouring element.

10. A stand-up bag according to claim 1, wherein the closure device includes reclosure strips configured to connect to one another.

11. A stand-up bag according to claim 10, wherein the reclosure strips are oriented parallel to the second side edge.

12. A stand-up bag according to claim 10, wherein a joining seam couples the front wall to the back wall between the second side edge and a lower edge of the reclosure strips.

13. A stand-up bag according to claim 1, wherein the closure device is concealed by a detachable bag section prior to opening the stand-up bag.

14. A stand-up bag according to claim 1, wherein the carrying handle and the first and second longitudinal sealing seams are collinear.

15. A stand-up bag according to claim 1, wherein the region of film separating the longitudinal sealing seams is formed from a third film cutting formed separately from and attached to the first film cutting.

16. A stand-up bag according to claim 1, wherein the region of film is free of preformed creases and seams.

17. A method for manufacturing a stand-up bag comprising:

positioning a carrying handle arrangement on an inner surface of a film section, the carrying handle arrangement having a carrying handle;

folding the film section on itself to form a front wall and a back wall such that the carrying handle arrangement is positioned on a first side edge of the folded film section, wherein, viewed in a longitudinal direction of the side edge, the front wall and the back wall are separated from one another along the first side edge at a segment above the carrying handle arrangement and at a segment below the carrying handle arrangement;

forming a base fold between the front wall and the back wall in an orientation transverse to the first side edge, wherein the base fold provides a standing base and is coupled to lower edges of the front wall and the back wall;

providing a closure device proximate a bag top situated opposite the base fold;

coupling the back wall to the front wall at the first side edge to provide a first longitudinal sealing seam above the carrying handle and a second longitudinal sealing seam below the carrying handle at the first side edge, the first and second longitudinal sealing seams being separated from one another by a region of film and connected by a frame-shaped sealing seam extending around the carrying handle, the carrying handle overlying the region of film being positioned a distance from the base fold and the bag top; and coupling the back wall to the front wall at a second side edge opposite the first side edge.

18. A method according to claim 17, further comprising separating the film section from abutting film sections, the film sections coupled to one another by a material web, wherein the film section is separated after placing the carrying handle arrangement and folding the film section.

19. A method according to claim 18, further comprising transporting the separated film section in a direction perpendicular to the first side edge.

20. A method according to claim 17, further comprising: forming an angled corner region that extends between the bag top and the second side edge, wherein the angled corner region is formed at least partially by the front wall, the back wall, and a top fold of the bag top; and attaching the closure device to the angled corner region.

21. A method according to claim 17, wherein providing a closure device comprises providing a closure device that includes reclosure strips positioned between inner surfaces of the front wall and the back wall and a top fold of the bag top.

22. A method according to claim 21, further comprising forming a tear line in the bag top between the second side edge and the reclosure strips.

* * * * *